US009223238B2

(12) United States Patent
Grillo et al.

(10) Patent No.: US 9,223,238 B2
(45) Date of Patent: Dec. 29, 2015

(54) PRODUCTION OF LATEX USING A WIPE FILM EVAPORATOR

(71) Applicant: Xerox Corporation, Norwalk, CT (US)

(72) Inventors: Amy A Grillo, Rochester, NY (US); Shigang Qiu, Toronto (CA); Peter V Nguyen, Webster, NY (US); Chieh-Min Cheng, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 262 days.

(21) Appl. No.: 13/921,002

(22) Filed: Jun. 18, 2013

(65) Prior Publication Data

US 2014/0370437 A1 Dec. 18, 2014

(51) Int. Cl.
*G03G 9/087* (2006.01)
*G03G 9/08* (2006.01)

(52) U.S. Cl.
CPC ..... *G03G 9/08755* (2013.01); *G03G 9/0804* (2013.01)

(58) Field of Classification Search
CPC ..... G03G 9/0804; G03G 9/09392
USPC ..... 523/239
See application file for complete search history.

(56) References Cited

U.S. PATENT DOCUMENTS

| | | | | |
|---|---|---|---|---|
| 6,054,530 | A * | 4/2000 | Webb et al. | 525/62 |
| 2005/0033068 | A1 * | 2/2005 | Hamunen et al. | 552/540 |
| 2010/0310979 | A1 * | 12/2010 | Ou et al. | 430/108.2 |

* cited by examiner

*Primary Examiner* — Hannah Pak

(57) ABSTRACT

A process is disclosed for making a resin emulsion suitable for use in forming toner particles including using a wiped film evaporator for removing residual solvents.

20 Claims, No Drawings

PRODUCTION OF LATEX USING A WIPE FILM EVAPORATOR

FIELD

The present disclosure relates to processes for producing resin emulsions useful in producing toners, The present disclosure relates to efficient processes for solvent stripping in phase inversion emulsification of polyester resins utilizing a wiped film evaporator.

BACKGROUND

Emulsion aggregation (EA) is a process for preparing toner. EA toners may be used in forming print and/or xerographic images. EA techniques may involve the formation of an emulsion latex of the resin particles by heating the resin using a batch. semi-continuous or continuous emulsion polymerization, as disclosed in, for example, U.S. Pat. No. 5,853,943, the disclosure of which hereby is incorporated by reference in entirety. Other examples of EA/coalescing processes for preparing toners are illustrated in U.S. Pat. Nos. 5,902,710; 5,910,387; 5,916,725 5,919,595; 5,925,488, 5,977,210, 5,994,020, and U.S. Publ. No. 2008/01017989 the disclosure of each of which hereby is incorporated by reference in entirety.

Polyester EA ultra low melt (ULM) toners have been prepared utilizing amorphous and crystalline polyester resins as illustrated, for example, in U.S. Publ. No. 2008/0153027, the disclosure of which hereby is incorporated by reference in entirety. The incorporation of the polyesters into the toner generally requires formulation into latex emulsions prepared by solvent in batch processes, for example, solvent flash emulsification and/or solvent-based phase inversion emulsification (PIE), which are time-consuming and energy-consuming.

In PIE, polyester resins are formed by dissolving a polyester resin in at least one organic solvent which then is removed, sometimes referred to as stripped, via a vacuum distillation process using a tube condenser resulting in an aqueous dispersion of resin particles. However, that is a slow process which typically takes about 14-16 hours to reach the specification of total residual solvents of <150 ppm for toner applications.

Accordingly, it would be advantageous to provide a process for the preparation of a polyester dispersion suitable for use in a toner product that is more efficient, takes less time, and results in a consistent toner product.

SUMMARY

The present disclosure describes a process which includes contacting at least one polyester resin with an organic solvent to form a resin mixture; heating the resin mixture; adding at least one solvent inversion agent to the mixture; neutralizing the resin mixture with a neutralizing agent; adding water to the mixture until phase inversion occurs to form a phase inversed mixture; and removing the solvent from the phase inversed mixture with a wiped film evaporator.

DETAILED DESCRIPTION

Before the present composition, methods and methodologies are described, it is to be understood that the subject matter of interest is not limited to particular compositions, methods, devices and experimental conditions described, as such compositions, methods and conditions ma vary. It is also to be understood that the terminology used herein is for purposes of describing particular embodiments only, and is not intended to be limiting, since the scope of the present subject matter will be described volitionally in the appended claims.

As used in the specification and the appended claims, the singular forms, "a", "an", and, "the," include plural references unless the context clearly dictates otherwise. Thus, for example, references to, "a particle," includes one or more particles, and/or compositions of the type described herein which will become apparent to those persons skilled in the art on reading the disclosure and so forth.

Unless defined otherwise, all technical and scientific terms used herein have the same meaning as commonly understood by one of ordinary skill in the art to which the subject matter belongs. Any methods and materials similar or equivalent to those described herein may be used in the practice or testing of the subject matter of interest, as it is understood that modifications and variations are encompassed within the spirit and scope of the instant disclosure.

As used herein, "about," "approximately," "substantially," and, "significantly," will be understood by a person of ordinary skill in the art and will vary in some extent depending on the context in which used. if there are uses of the term which are not clear to persons of ordinary skill in the art given the context in which it is used, "about," and, "approximately," will mean plus or minus less than about 10% of particular term and, "substantially," and, "significantly," will mean plus or minus less than about 10% of the particular term, which metrics are known in the art and are determinable practicing methods known in the art.

Previous disclosures cited above describe processes for making a polyester dispersion with phase inversion emulsion (PIE). However, the production of those dispersions by PIE, utilizing an efficient solvent stripping process via wiped film evaporators, has not been explored.

The present disclosure comprises using a wiped film evaporator, which term comprises short path evaporators and top vapor outlet (TVO) evaporators, for a more efficient solvent-based PIE of polyesters. The polyesters, in turn, may be used, for example for the preparation of ultra low melt toners. The present disclosure provides processes for forming a polyester dispersion with lower distillation times and much lower levels of residual solvents than may be achieved with current processes where solvents are removed by vacuum distillation using a tube condenser.

In embodiments, a process of the present disclosure may include contacting at least one polyester resin, optionally possessing acid groups with an organic solvent to form a resin mixture; heating the resin mixture; optionally adding at least one solvent inversion agent to the mixture; optionally neutralizing the resin mixture with a neutralizing agent; and contacting the resin mixture with a wiped film evaporator to remove residual solvents.

The present disclosure also provides processes for producing a polyester dispersion for making toner. In embodiments, a process of the present disclosure includes contacting at least one polyester resin with an organic solvent to form a mixture; heating the mixture; optionally adding at least one solvent inversion agent; optionally mixing a neutralizing agent with the mixture; adding water dropwise to the diluted mixture until phase inversion occurs to form a phase inversed mixture; and removing the solvents from the phase inversed mixture using a wiped film evaporator.

Resins

Any resin may be utilized in the present disclosure. The following discussion will focus on polyester resins. In embodiments resins may be an amorphous resin, a crystalline resin or a combination thereof. In further embodiments, the resin may be a polyester resin, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which hereby is incorporated hy reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5pentanediol 2,2-dimethylpropane-1,3-diol, 1,6-hexanediol, 1,7-heptanediol, 1,8-octanediol, 1,9-nonanediol, 1,10-decanediol, 1,12-dodecanediol and the like including their structural isomers. The aliphatic diol may be, for example, selected in an amount of from about 40 to about 60 mole percent, from about 42 to about 55 mole percent, from about 45 to about 53 mole percent. and an optional second diol may be used and can be selected in an amount of from about 0 to about 10 mole percent, from about 1 to about 4 mole percent of the resin.

Examples of diacids or diesters, including vinyl diacids or vinyl diesters, selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent, from about 42 to about 52 mole percent, from about 45 to about 50 mole percent, and optionally a second diacid can be used and can be selected in an amount of from about 0 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sehacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), and poly(octylene-adipate). Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide) and poly(butylene-succinimide).

The crystalline resin may be present, for example, in an amount of from about 5 to about 50 percent by weight of the toner components, from about 10 to about 35 percent by weight of the toner components. The crystalline resin can possess various melting points of, for example, from about 30° C. to about 120° C., from about 50° C. to about 90° C. The crystalline resin may have a number average molecular weight ($M_n$), as measured by gel permeation chromatography (GPC) of, for example, from about 1,000 to about 50,000, from about 2,000 to about 25,000, and a weight average molecular weight ($M_w$) of, for example, from about 2,000 to about 100,000, in embodiments from about 3,000 to about 80,000, as determined by GPC. The molecular weight distribution ($M_w/M_n$) of the crystalline resin may be, for example, from about 2 to about 6, from about 3 to about 5.

Examples of diacids or diesters including vinyl diacids or vinyl diesters utilized for the preparation of amorphous polyesters include dicarboxylic acids or diesters, such as, terephthalic acid, phthalic acid, isophthalic acid, fumaric acid, trimellitic acid, dimethyl fumarate, dimethyl itaconate, cis 1,4-diacetoxy-2-butene diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate dimethylsuccinate, dimethylfumarate, dimethylmaleate, dimethylglutarate, dimethyladipate, dimethyl dodecylsuccinate, and combinations thereof. The diacids or diesters may be present, for example, in an amount from about 40 to about 60 mole percent of the resin, from about 42 to about 52 mole percent of the resin, from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol bis(2-hydroxyethyl) oxide, dipropylene glycol, dibutylene and combinations thereof. The amount of diols selected may vary, and may be present, for example, in an amount from about 40 to about 60 mole percent of the resin, from about 42 to about 55 mole percent of the resin, from about 45 to about 53 mole percent of the resin, In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like.

In embodiments, an unsaturated amorphous polyester resin may be utilized as a latex resin. Examples of such resins include those disclosed in U.S. Pat. No. 6,063,827, the disclosure of which hereby is incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly (butyloxylated bisphenol co-maleate). poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propyiene itaconate), and combinations thereof.

The amorphous resin may be present in an amount of from about 30 to about 90 percent by weight of the toner components, from about 40 to about 80 percent by weight of the toner components. The amorphous resin or combination of amorphous resins utilized in the latex may have a glass transition temperature (Tg) of from about 30° C. to about 80° C. from about 35° C. to about 70° C. The combined resins utilized in the latex may have a melt viscosity of from about 10 to about 1,000,000 Pa*S at about 130° C., from about 50 to about 100,000 Pa*S, Polycondensation catalysts may be utilized in forming either the crystalline or amorphous polyesters and include tetraalkyl titanates, dialkyltin oxides, such as, dibutyltin oxide, tetraalkyltins such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), from about 10% (first resin)/90% (second resin) to about 90% (first resin)/10% (second resin), where the resin can include an amorphous resin and a crystalline resin, the weight ratio of the two resins may be from about 99% (amorphous resin): 1% (crystalline resin), to about 1% (amorphous resin): 90% (crystalline resin) or in other ratios as a design choice.

In embodiments, the resin may possess acid groups which, in embodiments, may be present at the terminus of a resin. Acid groups which may be present include carboxylic acid groups and the like. The number of acid groups may be controlled by adjusting the materials utilized to form the resin and reaction conditions.

In embodiments, the resin may be a polyester resin having an acid number from about 2 mg KOH/g, of resin to about 200 mg KOH/g of resin, from about 5 mg KOH/g of resin to about 50 mg KOH/g of resin.

Solvent

Any suitable organic solvent may be used, such as, alcohols, esters, ethers, ketones, amines, the like and combinations thereof, in an amount of, for example, from about 1 wt % to about 99 wt % resin, from about 10% to about 90%, from about 25% to about 85%, but amounts outside of those ranges can be used.

In embodiments, suitable organic solvents include, for example, methanol, ethanol, propanol, isopropanol, butanol, ethyl acetate, methyl ethyl ketone, pentanol, ethylene glycol, propylene glycol and the like, and combinations thereof. In embodiments, the organic solvent may be immiscible in water and may have a boiling point of from about 30° C. to about 120° C.

Any suitable organic solvent noted hereinabove may also be used as a phase or solvent inversion agent, and may be utilized in an amount of from about 1 wt % to about 25 wt % of the resin, from about 5 wt % to about 20 wt %.

Neutralizing Agent

Once obtained, the resin may be mixed at an elevated temperature, with a base, buffer or neutralizing agent added thereto. In embodiments, the base may be to solid or added in the form of a solution.

In embodiments, the neutralizing agent may be used to neutralize acid groups in the resins, so a neutralizing agent herein may also be referred to as a, "basic neutralization agent." An suitable basic neutralization agent may be used in accordance with the present disclosure. In embodiments, suitable basic neutralization agents may include both inorganic basic agents and organic basic agents. Suitable basic agents may include anunoniurn hydroxide, potassium hydroxide, sodium hydroxide, sodi urn carbonate, sodium bicarbonate, lithium hydroxide, potassium carbonate, organoamines, such as, triethyl amine, combinations thereof, and the like.

A latex emulsion may be formed in accordance with the present disclosure which may also include a small quantity of water, in embodiments, deionized water (DIW), in amounts of from about 1% to about 10% of resin weight, from about 3% to about 7%, at temperatures that melt or soften the resin, from about 0.5% to about 5%, from about 0.7% to about 3%.

The basic agent may be utilized, so present in an amount of from about 0.001% by weight. to 50% by weight of the resin, from about 0.01% by weight to about 25% by weight of the resin, from about 0.1% by weight to 5% by weight of the resin. In embodiments, the neutralizing agent may be added in the form of an aqueous solution.

A solid neutralizing agent may be added in an amount of from about 0.1 grams to about 2 grams, from about 0.5 grams to about 1.5 grams.

Utilizing the above basic neutralization agent in combination with a resin possessing acid groups, a neutralization ratio of from about 50% to about 300% may be achieved, from about 70% to about 200%. In embodiments, the neutralization ratio may be calculated using the following equation:

Neutralization ratio in an equivalent amount of 10% $NH_3$/resin(g)/resin acid value/0303*100.

Addition of the basic neutralization agent may raise the pH of an emulsion including a resin possessing acid groups from about 5 to about 12, from about 6 to about 11. The neutralization of the acid groups may, in embodiments, enhance formation of the emulsion.

Surfactants

In embodiments, the process of the present disclosure may include adding a surfactant to the resin, before or during the mixing, optionally at an elevated temperature, thereby enhancing formation of the phase inversed emulsion. In embodiments, the surfactant may be added prior to mixing, the resin at an elevated temperature. In embodiments, the surfactant may be added before, during, or after the addition of the basic agent. In embodiments, the surfactant may be added after heating with the addition of water to form the phase inversed latex. Where utilized, a resin emulsion may include one, two or more surfactants. The surfactants may he selected from ionic surfactants and nonionic surfactants. Anionic surfactants and cationic surfactants are encompassed hy the term, "ionic surfactants." In embodiments, the surfactant may be added as a solid or as a concentrated solution with a concentration of from about 10% to about 100% (pure surfactant) by weight, from about 15% to about 75% by weight. In embodiments, the surfactant may be utilized so that it is present in an amount of from about 0.01% to about 20% by weight of the resin, from about 0.1% to about 10% by weight of the resin, from about 1% to about 8% by weight of the resin. In embodiments, the surfactant may be added as a solid of from about 1 gram to about 20 grams, from about 3 grams to about 12 grams.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in erribodimentS, DOWFAX™ 2A1, an alkyldiphenyloxide disulfonate from The Dow chemical Company, and/or TAYCA POWER BN2060 from Tayca Corporation (Japan), which are branched sodium dodecyl benzene sulfonates. Combinations of the surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide. $C_{12}$,$C_{15}$,$C_{17}$-trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Examples of nonionic surfactants that may be utilized for the processes illustrated herein include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX-897™. Other examples of suitable nonionic surfactants may include a block copolymer of polyethylene oxide and polypropylene oxide, including those commercially available as SYNPERONIC PE/F, in embodiments, SYNPERONIC PE/F 108. Combinations of the surfactants and any of the foregoing nonionic surfactants may be utilized.

Colorants

Various known suitable colorants may be included, such as dyes, pigments, mixtures of dyes, mixtures of pigments, mixtures of dyes and pigments, and the like, may be included in the toner. In embodiments, the colorant may be included in the toner in an amount of, for example, 0 to about 35% by weight of the toner, from about 1 to about 25% by weight of the toner, from about 3 to about 20% by weight of the toner.

As examples of suitable colorants, mention may be made of carbon black like REGAL 330.®. (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites, MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof are used. The pigment or pigments are generally used as water-based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich, Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2GO1 (American Hoechst), Irgalite Blue RCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), CINQUASIA MAGENTA™ (DuPont), Paliogen Black L9984 (BASF), Pigment Black K801 (BASF), Levanyl Black A-SF (Miles, Bayer), combinations of the foregoing, and the like.

Other suitable water-based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse RHO 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668.X (Pigment Red 185 12516), Sunsperse RHO 9365X and 9504X (Pigment Red 57 15850: 1. Sunsperse YHD 6005X (Pigment Yellow 83 21108), Flexiverse. YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of craps include copper tetra(octadecyl sulfonamide) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxv-4-sulfonanilide phenylazo-4'-chloro-2,5-dimethoxy acetoacetanilide, and Permanent Yellow FGL.

In embodiments, the colorant may include a pigment, a dye, combinations thereof carbon black, magnetite, black, cyan, magenta, yellow, red green, blue, brown, combinations thereof, in an amount sufficient to impart the desired color to the toner. It is to be understood that other useful colorants will become readily apparent based on the present disclosures.

Wax

Optionally, a wax may also be combined with the resin in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from 0% by weight to about 25% by weight of the toner particles, from about 2% by weight to about 20% by weight of the toner particles.

When a wax dispersion is used, the wax dispersion may include any of the various waxes conventionally used in emulsion aggregation toner compositions. Waxes that may be selected include waxes having, for example, an average molecular weight of from about 500 to about 20,000, from about 1,000 to about 10,000.

Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide and polybutene waxes, such as, commercially available from Allied Chemical and Petrolite Corporation, for example, POLYWAX™ polyethylene waxes, such as, commercially available from Baker Petrolite, wax emulsions available from Michaelman, Inc, and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax, and jojoba oil; animal-based waxes, such as, beeswax; mineral-based waxes and petroleum-based waxes, such as, montan wax, ozokerite, ceresin, paraffin wax, microcrystalline wax, such as, waxes derived from distillation of crude oil, silicone waxes, mercapto waxes, polyester waxes, urethane waxes; modified polyolefin waxes (such as, a carboxylic acid-terminated polyethylene wax or a carboxylic acid-terminated polypropylene wax); Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate and pentaerythritol tetra behenate; ester waxes obtained from higher fatty acid and multivalent alcohol multimers, such as, diethyleneglycol monostearate, dipropyleneglycol distearate, diglyceryl distearate, and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example AQUA SUPERSLIP 6550™, SUPERSLIP 6530™ available from Micro Powder lnc., fluorinated waxes, for example POLYFLUO 190™, POLYFLUO 200™, POLYSILK 19™, POLYSILK 14™ from Micro Powder Inc., mixed fluorinated, amide waxes, such as, aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example, JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Processing

As noted above, the present process includes mixing at least one resin at an elevated temperature, in the presence of an organic solvent. More than one resin may be utilized. The resin may be an amorphous resin, as crystalline resin or as combination thereof. In embodiments, the resin may be an amorphous resin and the elevated temperature may be a temperature above the Tg of the resin. In embodiments, the resin may be a crystalline resin and the elevated temperature may be a temperature above the melting point of the resin. In embodiments, the resin may be a mixture of amorphous and crystalline resins and the temperature may be above the Tg of the mixture.

The process of making the emulsion may include contacting at least one resin with an organic solvent, heating the resin mixture to an elevated temperature, stifling the mixture, and, while maintaining the temperature at the elevated temperature, optionally adding a solvent inversion agent to the resin mixture, optionally adding a neutralizing agent to neutralize the acid groups of the resin, adding water dropwise into the mixture until phase inversion occurs to form a phase inversed latex emulsion, and removing the solvents by contacting the mixture with a wiped film evaporator.

In the phase inversion process, the amorphous and/or crystalline polyester resin may be dissolved in a low boding temperature organic solvent, which solvent is immiscible in water, such as, ethyl acetate, methyl ethyl ketone or any other solvent noted hereinabove, at a concentration of from about 1 wt % to about, 75 wt % of resin in solvent, from about 5 wt % to about 60 wt %. The resin mixture is then heated to a temperature of about 25° C. to about 90° C., from about 30° C. to about 85° C. The heating need not be held at a constant temperature, but may be varied. For example, the heating may be slowly or incrementally increased during heating until a desired temperature is achieved.

While the temperature is maintained in the aforementioned range, a solvent inversion agent may be added to the mixture. The solvent inversion agent, such as, an alcohol, such as, isopropanol, or any other solvent inversion agent noted hereinabove, in a concentration of from about 1 wt % to about 25 wt % of the resin, from about 5 wt % to about 20 wt %, may be added to the heated resin mixture, followed by the dropwise addition of Water, or optionally an alkaline base, such as ammonia, until phase inversion occurs (oil in water).

The aqueous alkaline composition and optional surfactant may be metered into the heated mixture at least until phase inversion is achieved. The aqueous alkaline composition and optional surfactant may be metered into the heated mixture, followed by the addition of an aqueous solution, in embodiments, DIW, until phase inversion is achieved.

In embodiments, a continuous phase inversed emulsion may be formed. Phase inversion can be accomplished by continuing to add an aqueous alkaline solution or basic agent, optional surfactant and/or water compositions to create a phase-inversed emulsion comprising a disperse phase including droplets comprising the molten ingredients of the resin composition, and a continuous phase comprising the surfactant and/or water composition.

A process of the present disclosure may include heating one or more ingredients of a resin composition to an elevated temperature, stirring the resin composition, and, while maintaining the temperature at the elevated temperature, adding the base or neutralizing agent, optionally in an aqueous alkaline solution, and optional surfactant into the mixture to enhance formation of the emulsion comprising a disperse phase and a continuous phase comprising the resin composition, and continuing to add the aqueous alkaline solution, optional surfactant and/or water until phase inversion occurs to form the phase-inversed emulsion.

A neutralizing agent may be added to the resin after it has been melt mixed. The addition of the neutralizing agent may be useful, in embodiments, where the resin utilized comprises acid groups. The neutralizing agent may neutralize the acidic groups of the resin, thereby enhancing formation of the phase-inversed emulsion and formation of particles suitable for use in forming toner compositions.

Prior to addition, the neutralizing agent may be at any suitable temperature, including room temperature of from about 20° C. to about 25° C., or an elevated temperature.

The neutralizing agent may be added at a rate of from about 0.01% wt % to about 10 wt % every 10 minutes, from about 0.5 wt % to about 5 wt % every 10 minutes, from about 1 wt % to about 4 wt % every 10 minutes. The rate of addition of the neutralizing, agent need not be constant, but can be varied.

In embodiments, where the process further includes adding water after the addition of basic neutralization agent and optional surfactant, the water may be metered into the mixture at a rate of about 0.01 wt % to about 10 wt % every 10 minutes, from about 0.5 wt % to about 5 wt % every 10 minutes, from about 1 wt % to about 4 wt % every 10 minutes. The rate of water addition need not be constant, but can be varied.

Although the point of phase inversion may vary depending, on the components of the emulsion, the temperature of heating, the stirring speed, and the like, phase inversion may occur when basic neutralization agent, optional surfactant, and/or water were added so that the resulting resin is present in an amount from about 5 wt % to about 70 wt % by weight of the emulsion, from about 20 wt % to about 65 wt % by weight of the emulsion, from about 30 wt % to about 60 wt % by weight of the emulsion.

A wiped film evaporator is used to remove residual solvent present in the phase inversion process. The evaporator reduces the distillation time significantly. Such evaporators enable shorter residence times, can be operated under pressure, good heat transfer, operate with viscous fluids or fouling fluids, can remove up to 90% or more distillate in a single pass and have no bottom steady bearing.

The total residual solvent is reduced to less than about 150 ppm in less than about 5 hours, less than about 4 hours, less than about 3 hours, less than about 2 hours; less than about 100 ppm in less than about 6 hours, less than about 5 hours, less than about 4 hours, less than about 3 hours; less than about. 50 ppm in less than about 7 hours, less thtm about 6 hours, less than about 5 hours, less than about 4 hours; from about 0 ppm to about 40 ppm in less than about 8 hours, less than about 7 hours, less than about 6 hours, less than about 5 hours.

The mixture may be fed into an extruder, including that the polymer-solvent mixture may be heated prior to being feed into the extruder. Heating vessels are suitable for holding the mixture prior to introduction into the extruder. The heated polymer-solvent mixture may further be heated by means of a heat exchanger or exchangers. Pumps, such as, gear pumps, may be used to transfer the polymer-solvent mixture through one or more heat exchangers.

The extruder used in the method as disclosed may comprise any number of barrels or other types of screw elements. Exemplary extruders include a twin-screw counter-rotating extruder, a twin-screw co-rotating extruder, a single-screw extruder, or a single-screw reciprocating extruder. The extruder can be intermeshing i.e. self wiping).

The extruder comprises a wiped film evaporator. The polmer-solvent mixture is introduced into the evaporator or a second extruder to concentrate the mixture prior to introduction to the extruder. The evaporator may be upstream from the extruder and in direct communication with the extruder via a pressure control valve attached directly to the extruder.

The process is performed to provide resin emulsion particles with an average diameter size of, for example, from about 50 nm to about 250 nm, from about 120 to about 180 nm.

At phase inversion, the resin particles become emulsified and dispersed within the aqueous phase. That is, an oil-in-water emulsion of the resin particles in the aqueous phase is formed. Phase inversion may be confirmed by, for example, measuring via any of the techniques within the purview of those skilled in the art.

Phase inversion may permit formation of the, emulsion at temperatures avoiding premature crosslinking of the in of the emulsion.

Stirring, may be utilized to enhance formation of the phase inversed emulsion. Any suitable stirring device may be utilized. The stirring need not be at a. constant speed, but may be varied. For example, as the heating of the mixture becomes more uniform, the stirring rate may be increased. In embodiments, the stirring may be at from about 10 revolutions per minute (rpm) to about 5,000 rpm, from about 20 rpm to about 2,000 rpm, from about 50 rpm to about 1,000 rpm. In embodiments, a homogenizer (that is, a high shear device), may be utilized to form the phase inversed emulsion. When utilized, a homogenizer may operate at a rate of from about 3,000 rpm to about 10,000 rpm.

Preparation of polyester emulsions of the present disclosure may include dissolution of at least one resin in at least one organic solvent, heating the mixture to an elevated temperature, neutralization using a neutralizing agent, inversion through mixing with a solvent inversion agent and water, and finally removal of the solvent from the emulsion using a short path wiped film evaporator or a TVO evaporator. That process offers several advantages over current solvent-based processes for the formation of emulsions both at the laboratory and industrial scale.

Wiped film evaporators are beneficial in difficult solvent stripping operations. The wiped film evaporator excels in distillation steps where products are heat-sensitive, viscous, tend to foul on heated surface, or are high temperature boiling. Wiped film evaporators with internal condensers are called short path evaporators and may operate under high vacuum. Wiped film evaporators without internal condensers are called TVO evaporators and may be employed as column reboilers or in very dirty applications.

The operation process in a wiped film evaporator generally occurs in an upright roughly cylindrical device. Feed is introduced at the top of the unit and spread on a shell inner surface by a rotating distributor or distribution plate. Wipers wipe the feed thus creating and renewing the film. The thin film enables an efficient heat transfer even for viscous fluids. The low boiling temperature component evaporates and passes through an entrainment separator. That minimizes carryover of liquid droplets along with the vapors. The vapors are removed through a vapor line to an optional external condenser (not shown) and condensed.

For solvent stripping applications which demand low pressure drop, the central section of the evaporator can be provided with a condenser, thus making the unit a short path/molecular distillation unit. In that case, the vapors are allowed to condense on the outside of the tube bundle and flow out of the evaporator via a condensate or bottoms outlet provided at the center. The high boiling temperature component flows along the shell wall and is discharged from a product or distillate outlet. Wiper action promotes downward flow. The product/concentrate will be in fluid form at the operating temperature. Different designs of rotors are available depending on the product, the viscosity and the process pressure, and may include a drive and heating jacket, for example.

The process of the present disclosure for the production of polyester latex emulsions using PIE permits high throughput experimental screening high throughput production rates, eliminates or minimizes wasted product, greatly reduces time to market for the latex production, and produces latexes with more efficient solvent. stripping.

Following phase inversion, additional surfactant, water, and/or aqueous alkaline solution may optionally be added to dilute the phase inversed emulsion, although that is not required. Following phase inversion, the phase inversed emulsion may be cooled to room temperature, for example, from about 20° C. to about 25° C.

The emulsified resin particles in the aqueous medium may have a submicron size, for example, of about 1 μm or less, from about 500 nm or less, from about 10 nm to about 500 nm, from about 50 nm to about 400 nm, from about 100 nm to about 300 nm. Adjustments in particle size can be made by modifying the ratio of water to resin flow rates, the neutralization ratio, solvent concentration and solvent composition.

Toner Preparation

The toner particles may be prepared by any method within the purview of one skilled in the art. Although embodiments relating to toner particle production are described below with respect to EA processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety.

In embodiments, toner compositions and toner particles may be prepared by aggregation and coalescence processes in which small-sized resin particles, which can be mixed with one or more optional toner reagents, are aggregated to the appropriate toner particle size and then coalesced to achieve the final toner particle shape and morphology.

In embodiments, a process of the present disclosure includes melt mixing at least one resin at an elevated temperature in the presence of an organic solvent as discussed above; optionally adding a surfactant either before, during or after melt mixing the resin; optionally adding one or more additional ingredients of a toner composition, such as, colorant, wax, and other additives; adding a solvent inversion agent, a basic agent, water; performing a phase inversion to create a phase inversed emulsion comprising toner-sized droplets comprising the molten resin and the optional ingredients of the toner composition; exposing the emulsion to a wipe film evaporator; and solidifying the toner-sized droplets to result in toner particles.

In embodiments, the optional additional ingredients of a toner composition including colorant, wax and other additives may be added before, during or after the melt mixing the resin. The additional ingredients can be added before, during or after the addition of the optional surfactant. In further embodiments, the colorant may be added before the addition of the optional surfactant.

In embodiments, the mixture of components can be present in an amount of from about 5 wt % to about 25 wt of crystalline resin, about 60 wt % to about 90 wt % of amorphous resin, about 3 wt % to about 15 wt % of colorant, and optionally from about 5 wt % to about 15 wt % of a wax dispersion, and wherein the total weight percent of all components is 100 wt % of the toner. The amount of optional anionic surfactant utilized is from about 0 wt % to about 3 wt % of the toner, but not included in the total weight percent of the toner since the surfactant is usually eventually removed from the toner composite by washing.

"Toner-sized," indicates that the droplets have a size comparable to toner particles used in xerographic printers and copiers. Toner-sized, in embodiments, can indicate a volume average diameter of for example, from about 2 μm to about 25 μm, from about 3 μm to about 15 μm, from about 4 μm to about 10 μm. Droplet size may be determined by solidifying the toner-sized droplets and then measuring the resulting toner particles.

Because the droplets may be toner-sized in the disperse phase of the phase inversed emulsion, there may be no need to aggregate the droplets to increase the size thereof prior to solidifying the droplets to result in toner particles. However, such aggregation/coalescence of the droplets is optional and can be employed in embodiments of the present disclosure, including the aggregation/coalescence techniques described, in, for example, U.S. Publ. No. 2007/0088117, the disclosure of which hereby is incorporated by reference in entirety.

The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized. If the mixture is homogenized, homogenization maybe accomplished by mixing at about 600 to about 6,000 rpm. Homogenization may be accomplished by any suitable means, including, for example, an IKA ULTRA TURRAX T50 probe homogenizer.

Following preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent, such as, polyaluminum halides, such as, polyaluminum chloride (PAC), or the corresponding bromide, fluoride, or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the Tg of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethylammoniurn bromide, benzalkonium chloride, cetyl pyridinium bromide, $C_{12}$, $C_{15}$,$C_{17}$-trimethyl ammonium bromides, halide salts of quatemized polyoxyethylalkylamines, dodecylbenzyl triethyl ammonium chloride, and the like, and mixtures thereof.

Other suitable aggregating agents also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the aggregating agent is a polyion aggregating agent, the agent may have any desired number of polyion atoms present. For example, in embodiments, suitable polyaluminum compounds have from about 2 to about 13, in embodiments, from about 3 to about 8, aluminum ions present in the compound.

The aggregating agent may be added to the mixture utilized to form a toner in an amount of, for example, from about 0% to about 10% by weight, from about 0.2% to about 8% by weight, from about 0.5% to about 5% by weight, of the resin in the mixture.

The particles may be permitted to aggregate until a predetermined desired particle size is obtained. Samples may be taken during the growth process and analyzed, for example with a COULTER COUNTER, for average particle size. The aggregation thus may proceed by maintaining the elevated temperature, or slowly raising the temperature to, for example, from about 40° C. to about 1000° C., and holding the mixture at that temperature for a time of from about 0.5 hours to about 6 hours, from about 1 hr to about 5 hours, while maintaining stirring, to provide the aggreg,ted particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., from about 45° C. to about 80° C., which may be below the Tg of the resin.

Once the desired final size of the toner particles is achieved, the pH of the mixture may be adjusted with a base to a value of from about 3 to about 10, from about 5 to about 9. The adjustment of the pH may be utilized to freeze, that is, to stop, toner growth. The base utilized to stop toner growth may include any suitable base, such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. In embodiments, a buffer may be used to elevate the pH.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a polyester amorphous resin latex as described above may be included in the shell.

In embodiments, resins which may be utilized to form a shell include, but are not limited to, a crystalline resin latex described above, and/or the amorphous resins described above that may be formed by the phase inversion emulsification processes of the present disclosure. In embodiments an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin may be present in an amount of from about 20 percent by weight to about 100 percent by weight of the total shell resin, from about 30 percent by weight to about 90 percent by weight of the total shell resin. Thus, in embodiments, a second resin may be present in the shell resin in an amount of from about 0 percent by weight to about 80 percent by weight of the total shell resin, from about 10 percent by weight to about 70 percent by weight of the shell resin.

The shell may comprise charged or chargeable molecules, such as, a colorant, such as, a black colorant.

The shell resin may be applied to the aggregated particles by any method within the purview of those skilled in the art. In embodiments, the resins utilized to form the shell may be in an emulsion including any surfactant described above. The emulsion possessing the resins, optionally the solvent free crystalline polyester resin latex neutralized with piperazine described above, may be combined with the aggregated particles described above so that the shell forms over the aggregated particles.

Formation of the shell may occur while heating to a temperature of from about 30° C. to about 80° C. from about 35° C. to about 70° C. Formation of the shell may take place for a period of time of from about 5 min to about 10 hrs, from about 10 min to about 5 hrs.

Coalescence

Following aggregation to the desired particle size and application of any optional shell, the particles may then be coalesced to the desired final shape, the coalescence being achieved by, for example, heating the mixture to a temperature of from about 45° C. to about 100° C., from about 55° C. to about 99° C., which may be at or above the Tg of the resins utilized to form the toner particles, and/or reducing the stirring, such as, from about 100 rpm to about 1,000 rpm, from about 200 rpm to about 800 rpm. Higher or lower temperatures may be used, it being understood that the temperature is a function of the resins used for the binder. Coalescence may be accomplished over a period of from about 0.01 to about 9 hrs, from about 0.1 to about 4 hrs.

After aggregation and/or coalescence, the mixture may be cooled to room temperature (RT), such as, from about 20° C. to about 25° C. The cooling may he rapid or slow, as desired.

A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example, in an amount of from about 0.1 to about 10% by weight of the toner, from about 1 to about 3% by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which hereby is incorporated by reference in entirety; organic sulfate and sulfonate compositions, including those disclosed in U.S. Pat. No. 4,338,390, the disclosure of which hereby is incorporated by reference in entirety; cetyl pyridinium tetrafluoroborates; distearyl dimethyl ammonium methyl sulfate; aluminum salts, such as, BONTRON E84™ or E88™ (Chemical Industries, Ltd.); combinations thereof, and the like.

There can also be blended with the toner particles external additive particles after formation including flow aid additives, which additives may be present on the surface of the toner particles. Examples of these additives include metal oxides, such as, titanium oxide, silicon oxide, aluminum oxides, cerium oxides, tin oxide, mixtures thereof, and the like; colloidal and amorphous silicas, such as, AEROSIC®, metal salts and metal salts of fatty acids inclusive of zinc stearate, calcium stearate, or long chain alcohols, such as, UNILIN 700, and mixtures thereof.

In general, silica may be applied to the toner surface for toner flow, tribo enhancement, admix control, improved development and transfer stability and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of the external additives may be present in an amount of from about 0.1% by weight to about 5% by weight of the toner, from about 0.25% by weight to about 3% by weight of the toner. In embodiments, the toners may include, for example, from about 0.1% by weight to about 5% by weight titania, from about 0.1% by weight to about 8% by weight silica, and from about 0.1% by weight to about 4% by weight zinc stearate.

Suitable additives include those disclosed in U.S. Pat. Nos. 3,590,000 and 6,214,507, the disclosure of each of which hereby is incorporated by reference in entirety.

Toners produced in accordance with the present disclosure may possess excellent charging characteristics when exposed to extreme relative humidity (RH) conditions. The low humidity zone (C-zone) may be about 10° C./15% RH, while the high humidity zone (A-zone) may be about 28° C./85% RH. Charge distribution (q/d) of the toners of the present disclosure may be from about −3 mm to about 15 mm, from about −5 to about 12 mm, from about −7.5 mm to about −10.5 mm. Toners of the present disclosure may possess a parent toner charge per mass ratio (q/m) in ambient conditions (B-zone) of about 21° C./50% RH of from about 25 μC/g to about 65 μC/g, from about 30 μC/g to about 60 μC/g, from about 35 μC/g to about 50 μC/g.

Developer

In embodiments, toner particles can be combined with a carrier to form a developer. The carrier can be coated. The carrier can comprise a colorant. Known materials and methods can be practiced to make a developer comprising a resin made as taught herein.

The following Examples are being submitted to illustrate embodiments of the present disclosure. The Examples are intended to be illustrative only and are not intended to limit the scope of the present disclosure. Also, parts and percentages are by weight unless otherwise indicated. As used herein, "room temperature," refers to a temperature of from about 20° C. to about 25° C.

EXAMPLES

A 2L-scale phase inversion emulsification (PIE) process is used for screening of evaporator efficiency. A short path evaporator is utilized for initial lab screening of solvent removal efficiency in the PIE process across. About 10 wt % of a high molecular-weight amorphous polyester resin, about 6.9 wt % of methyl ethyl ketone (MEK) and about 1.5 wt % of 2-propanol (IPA) are added to a glass reaction vessel, heated to about 45° C. and allowed to dissolve with stirring for about 2 hours. About 0.3 wt % of a 10% ammonia solution then is added dropwise to the resin solution and the combination is left to stir for about 10 minutes at a temperature of about 40° C. DIW, heated to about 40° C. via a heat exchanger, is fed to the neutralized resin by a metering pump, (i.e., a Knauer pump) over about a 2 hour period. Thereafter, a tube condenser or short path wiped film evaporator is used to remove the solvent, which occurs in about 4 hours to achieve a total solvent content of less than about 150 ppm, as compared to existing vacuum distillation using tube condensers where it can take at least 14 hours to achieve a total solvent content of less than about 150 ppm.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

We claim herein:

1. A phase inversion emulsification (PIE) process consisting essentially of:

contacting at least one polyester resin possessing acid groups with an organic solvent to form a resin mixture;

heating the resin mixture;

adding at least one solvent inversion agent to the mixture;

neutralizing the resin mixture with a neutralizing agent;

adding water to the mixture until phase inversion occurs to form a phase inversed mixture; and removing the solvents from the phase inversed mixture with a wiped film evaporator to yield resin particles, wherein the total residual solvents are reduced to less than about 150 ppm in less than about 5 hours, or the amount of residual solvents is reduced to about 10 ppm to about 20 ppm in about 8 hours.

2. The process of claim 1, wherein the total residual solvents are reduced to less than about 150 ppm in less than about 5 hours.

3. The process of claim 1, wherein the amount of residual solvents are reduced to about 10 ppm to about 20 ppm in about 8 hours.

4. The process of claim 1. wherein the wiped film evaporator comprises a short path evaporator or a top vapor outlet (TVO) evaporator.

5. The process of claim 1, wherein the polyester resin is selected from the group consisting of amorphous resins, crystalline resins and combinations thereof.

6. The process of claim 1, wherein the neutralizing agent is added in the form of an aqueous solution selected from the group consisting of ammonium hydroxide, potassium hydroxide, sodium hydroxide, sodium carbonate, sodium bicarbonate, lithium hydroxide, potassium carbonate, organoamines and combinations thereof, and raises the pH of the resin mixture to from about 5 to about 12.

7. The process of claim 1, wherein the resin mixture is heated to a temperature of from about 25°C. to about 90°C.

8. The process of claim 1, wherein the organic solvent is selected from the group consisting of an alcohol, ester, ether, ketone, an amine and combinations thereof.

9. The process of claim 1, wherein the solvent inversion agent is an alcohol selected from the group consisting of methanol, ethanol, propanol, butanol, pentanol, ethylene glycol, propylene glycol, and combinations thereof.

10. A phase inversion emulsification (PIE) process consisting essentially of:

contacting at least one polyester resin with an organic solvent form a mixture;

heating the mixture;

diluting the mixture to a desired concentration by adding at least one solvent inversion agent to form a diluted mixture;

mixing an aqueous solution of neutralizing agent with the diluted mixture;

adding water dropwise to the diluted mixture until phase inversion occurs to form a phase inversed mixture; and contacting the phase inversed mixture with a wiped film evaporator to yield resin particles, wherein the total residual solvents are reduced to less than about 150 Ppm in less than about 5 hours, or the amount of residual solvents is reduced to about 0 ppm to about 40 ppm in about 8 hours.

11. The process of claim 10, wherein the total residual solvents is reduced to less than about 150 ppm in less than about 5 hours.

12. The process of claim 10, wherein the amount of residual solvents is reduced to about 0 ppm to about 40 ppm in about 8 hours.

13. The process of claim 10, wherein the wiped film evaporator comprises a short path evaporator or a top vapor outlet (IVO) evaporator.

14. The process of claim 13, wherein the wiped film evaporator comprises a short path evaporator.

15. The process according to claim 10, wherein the polyester resin comprises a polyester resin selected from the group consisting of amorphous resins crystalline resins, and combinations thereof.

16. The process according to claim 10, wherein the neutralizing agent is added in the form of an aqueous solution selected from the group consisting of ammonium hydroxide, potassium hydroxide, sodium hydroxide, sodium carbonate, sodium bicarbonate, lithium hydroxide, potassium carbonate organoamines, and combinations thereof, and raises the pH of the resin mixture to from about 5 to about 12.

17. The process of claim 10, wherein the mixture is heated to a temperature of from about 25°C. to about 90°C.

18. The process of claim 10, wherein the organic solvent is selected from the group consisting of an alcohol, an ester, an ether, a ketone, an amine, and combinations thereof.

19. The process of claim 10, wherein the solvent inversion agent is an alcohol selected from the group consisting of methanol, ethanol, propanol, butanol, pentanol, ethylene glycol, propylene glycol, and combinations thereof.

20. The process of claim 10, wherein the wiped film evaporator is attached to an extruder.

* * * * *